United States Patent [19]

Crawford

[11] 4,138,347

[45] Feb. 6, 1979

[54] SYNTHETIC DIESTER LUBRICATING OILS CONTAINING OVERBASED CALCIUM SULFONATES AND NONYLPHENOL ETHYLENE-OXIDE ADDUCTS

[75] Inventor: Wheeler C. Crawford, Houston, Tex.

[73] Assignee: Texaco Inc., New York, N.Y.

[21] Appl. No.: 892,614

[22] Filed: Apr. 3, 1978

[51] Int. Cl.[2] ..... C10M 1/40; C10M 3/34; C10M 5/22; C10M 7/38

[52] U.S. Cl. ..... 252/33; 252/52 A; 252/389 R

[58] Field of Search ..... 252/33, 52 A, 389 R

[56] References Cited

U.S. PATENT DOCUMENTS

| | | | |
|---|---|---|---|
| 2,681,315 | 6/1954 | Longberg et al. | 252/52 R |
| 3,872,048 | 3/1975 | Brown | 252/52 A |

*Primary Examiner*—Irving Vaughn

*Attorney, Agent, or Firm*—Thomas H. Whaley; Carl G. Ries; Henry W. Archer

[57] ABSTRACT

Small amounts of adducts of nonylphenol and ethylene oxide defined by the general formula:

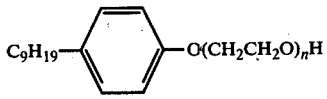

wherein n ranges from 1 to 9.5 are found to have a dispersing and/or solubilizing action on overbased calcium sulfonates in 100 percent synthetic diester base lubricating oils. Best results are obtained where an adduct in which n is 6 is used in an oil comprising essentially di(2-ethylhexyl)azelate.

The concentration of adduct basis oil ranges from about 0.5 weight percent to 1.5 wt. %.

6 Claims, No Drawings

SYNTHETIC DIESTER LUBRICATING OILS CONTAINING OVERBASED CALCIUM SULFONATES AND NONYLPHENOL ETHYLENE-OXIDE ADDUCTS

FIELD OF THE INVENTION

This invention concerns synthetic lubricating oils, particularly internal crankcase lubricants containing overbased calcium sulfonates rendered soluble and/or dispersed therein by the addition of small amounts of certain nonylphenol ethylene oxide adducts.

STATE OF THE ART

Overbased calcium sulfonates are widely used in mineral oils, in particular in crankcase lubricants because of their excellent dispersant and/or detergent qualities and their property of neutralizing acidic substances thereby preventing excessive rusting of parts. Such use is described, inter alia, in U.S. Pat. Nos. 2,467,176; 2,485,861; 2,501,731; 3,384,585; 3,312,618; and 3,242,079. Heretofore, overbased calcium sulfonates as shown by the above listed patents, have been used with mineral hydrocarbon oils. Previous attempts to formulate a 100% synthetic diester base oil lubricating oil with calcium sulfonates were unsuccessful because of the insolubility of the sulfonates in the synthetic oils. By "synthetic oils" for the purposes of this disclosure is meant any of the hydrophobic compounds of lubricating viscosity including the aliphatic diesters such as bis-2-ethylhexyl sebacate and azelate; bis-dinonyl adipate; alkyl mixed pentaerythritol esters and esters of naphthenic acids.

SUMMARY OF THE INVENTION

In accordance with the present invention, it has now been found that unexpectedly and surprisingly the addition of small amounts of certain nonylphenol ethylene oxide adducts to the above-described synthetic oils will cause the dispersion and/or the solution of the calcium sulfonates having an overbased ratio range of 0.3 to 18 in such oils, and enhance the rust protection of the oils.

The adducts used therein are those defined by the generic formula:

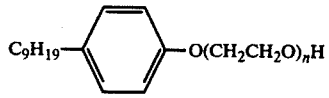

wherein n ranges from 1 to 9.5. Preferred among these is the adduct marketed by Jefferson Chemical Company under the trademarked name "Surfonic N60", wherein n is 6. The total adduct concentration basis weight of oil ranges from 0.5 weight percent to 1.50 wt %. A dosage lower than 0.5 weight percent is ineffective for the purpose of this invention.

DISCLOSURE OF THE INVENTION

In the practice of the invention, calcium sulfonate is blended with the synthetic oils and the adduct is then blended therein at 150° F. using a laboratory mixer.

The invention is effective particularly when the calcium sulfonates have a relatively high overbasing ratio, as expressed by their Total Base Number (TBN) where a TBN of 0 is assigned to the neutral salt, ranging from 30 to 400.

Column A of table I below shows the insolubility of calcium sulfonates in the synthetic ester at a treating level typically used to formulate 1% ash oils of SE quality. The additive is insoluble. Columns B-E provide data establishing that the minimum amount of Surfonic N-60 to solubilize 0.23 wt. % Ca from sulfonates is 0.5 wt. %. This is also the optimum concentration of Surfonic N-60 to maintain calcium in solution at low temperatures. Blends with higher concentrations of Surfonic N-60 develop a definite haziness on storage at low temperature. The blend with 0.25% Surfonic N-60 developed a barely perceptible haze on storage. The high lumetron turbidity for this blend (Col. E, 26.0 lumetron) also indicates that 0.25% Surfonic N-60 is too low a dosage to solubilize calcium sulfonates.

Blend F shows that even 0.12% calcium sulfonate will not dissolve in di(2-ethylhexyl) adipate.

Using 0.11% Ca from a calcium sulfonate with a lower overbasing ratio than the other and hence less CaCO3, shows that the solubility is greater, even in the absence of "Surfonic N-60", in this case (Blend F vs. Blend J.) Higher overbasicity would lead to solubility problems basis high Lumetron number for Blend I (0.16 Ca).

Using 6.2 overbased calcium sulfonates shows that 0.23% Ca from this additive is not soluble (Blend G), and that lower calcium than 0.23% concentrations could have solubility problems e.g. Blend H.

Surfonic N-60 can also be used to solubilize calcium sulfonates in a synthetic base stock composed of esters of naphthenic acids which are not dimer acids (see Blends L, M). Surprisingly, calcium sulfonate (420 TBN) was found to be soluble in 2-ethyl-hexyl esters of dimer acids but the 7.0 lumetron number (Blend N) indicates that solubility is not as great as desired and thus Surfonic N-60 can be used to improve the solubility in this case too.

USE OF ADDUCTS TO SOLUBILIZE HIGHLY OVERBASED CALCIUM SULFONATES IN ESTERS

| Blend | A | B | C | D | E | F | G | H |
|---|---|---|---|---|---|---|---|---|
| Di(-2-ethylhexyl) adipate | 98.50 | 97.00 | 97.50 | 98.00 | 98.25 | 99.25 | 90.0 | 98.50 |
| Esters of naphthenic acids | — | — | — | — | — | — | — | — |
| 2-Ethyl hexyl esters of dimer acids | — | — | — | — | — | — | — | — |
| Calcium sulfonates A | 1.50 | 1.50 | 1.50 | 1.50 | 1.50 | 0.75 | — | — |
| B | — | — | — | — | — | — | 10.0 | 1.50 |
| C | — | — | — | — | — | — | — | — |
| Surfonic N-60 | — | 1.50 | 1.00 | 0.50 | 0.25 | — | — | — |
| % Ca | 0.25 | 0.25 | 0.25 | 0.25 | 0.25 | 0.12 | 0.20 (Calc.) | 0.026 |
| Appearance | Two | Clear | Clear | Clear | Slight haze | Two phases | Two phases | Clear |
| Lumetron Turbidity,% | Unsuitable | 1.0 | 3.0 | 3.0 | 26.0 | Unsuitable | Unsuitable | 7.0 |

A TBN = 420
B TBN = 6.2
C TBN = 300

-continued

USE OF ADDUCTS TO SOLUBILIZE HIGHLY OVERBASED CALCIUM SULFONATES IN ESTERS

| Blend | I | J | K | L | M | N |
|---|---|---|---|---|---|---|
| Di(-2-ethylhexyl) adipate | 98.50 | 99.0 | — | — | — | — |
| Esters of naphthenic acids | — | — | 98.50 | 97.50 | 98.00 | — |
| 2-Ethyl hexyl esters of dimer acids | — | — | — | — | — | 98.5 |
| Calcium sulfonates A | — | — | 1.50 | 1.50 | 1.50 | 1.50 |
| B | — | — | — | — | — | — |
| C | 1.50 | 1.0 | — | — | — | — |
| Surfonic N-60 | — | — | — | 1.00 | 0.50 | — |
| % Ca | 0.16 | 0.11 | 0.25 (Calc.) | 0.21 | 0.22 | 0.23 |
| Appearance | Clear | Clear | Two Phases | Clear | Clear | Clear |
| Lumetron Turbidity,% | 9.0 | 4.5 | Unsuitable | 4.0 | 26.0 | 7.0 |

A TBN = 420
B TBN = 6.2
C TBN = 300

Other conventional additives can be added in usual amounts with the lubricants of the present invention. Such additives include extreme pressure agents, dispersants, VI improvers and the like.

What we claim is:

1. A synthetic diester lubricating oil containing an effective amount of overbased calcium sulfonates and from about 0.5 to about 1.5 weight percent of said oil of an adduct of the formula:

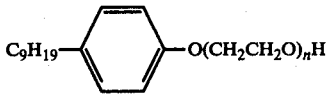

wherein n ranges from 1 to 9.5; said adduct serving to disperse and/or solubilize said calcium sulfonates in said oil and to enhance the oxidation protection of said oil.

2. The lubricating oil of claim 1 wherein said adduct has the formula:

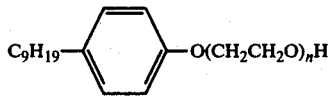

wherein n = 6.

3. The invention as defined in claim 1, wherein said oil consists essentially of di(2-ethylhexyl)azelate.

4. A process for solubilizing and/or dispersing overbased calcium sulfonates in a synthetic diester lubricating oil which consists in blending calcium sulfonates with said oil in from about 0.5 to about 1.5 weight percent of an adduct of the formula:

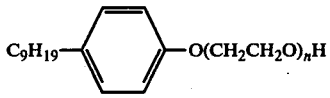

wherein n ranges from 1 to 9.5

5. The process of claim 4, wherein said oil consists essentially of di(2-ethylhexyl) azelate.

6. The process of claim 4, wherein said oil consists essentially of di(2-ethylhexyl) adipate.

* * * * *